US007758364B1

(12) United States Patent
Ruden et al.

(10) Patent No.: US 7,758,364 B1
(45) Date of Patent: Jul. 20, 2010

(54) ROTARY POSITIONING

(75) Inventors: Shawn Allen Ruden, Shakopee, MN (US); John William Rigsby, Longmont, CO (US)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 12/535,486

(22) Filed: Aug. 4, 2009

(51) Int. Cl.
*H01R 3/00* (2006.01)

(52) U.S. Cl. ..... 439/164

(58) Field of Classification Search ..... 439/164, 439/4, 11, 13, 162, 163, 165
See application file for complete search history.

(56) References Cited

U.S. PATENT DOCUMENTS

| | | | | | |
|---|---|---|---|---|---|
| 2,664,477 | A | * | 12/1953 | Lewis et al. | 200/61.39 |
| 3,590,854 | A | | 10/1968 | Cork | |
| 3,597,721 | A | * | 8/1971 | Mangan | 439/164 |
| 3,779,003 | A | | 12/1973 | Boissevan et al. | |
| 4,299,662 | A | * | 11/1981 | Hardin, Jr. | 376/260 |
| 4,462,565 | A | | 7/1984 | Johnson | |
| 4,978,191 | A | | 12/1990 | Hasegawa et al. | |
| 5,044,968 | A | * | 9/1991 | Bannai et al. | 439/164 |
| 5,174,515 | A | | 12/1992 | Meier | |
| 5,310,356 | A | * | 5/1994 | Obata et al. | 439/169 |
| 5,413,492 | A | * | 5/1995 | Obata | 439/164 |
| 5,580,259 | A | * | 12/1996 | Bolen et al. | 439/164 |
| 5,772,146 | A | * | 6/1998 | Kawamoto et al. | 242/388 |
| 5,827,080 | A | * | 10/1998 | Tanaka et al. | 439/164 |
| 5,882,216 | A | * | 3/1999 | Matsumoto et al. | 439/164 |
| 5,888,084 | A | * | 3/1999 | Mukai et al. | 439/164 |
| 5,919,054 | A | * | 7/1999 | Herlach et al. | 439/164 |
| 5,980,287 | A | * | 11/1999 | Sasaki | 439/164 |
| 6,012,935 | A | | 1/2000 | Bolen et al. | |
| 6,156,974 | A | | 12/2000 | Blase | |
| 6,164,994 | A | * | 12/2000 | Bolen et al. | 439/164 |
| 6,354,854 | B1 | * | 3/2002 | Matsuzaki | 439/164 |
| 6,364,676 | B2 | * | 4/2002 | Bunselmeier et al. | 439/164 |
| 6,572,393 | B2 | * | 6/2003 | Kawamura | 439/164 |
| 6,641,404 | B2 | * | 11/2003 | Matsuzaki et al. | 439/15 |
| 6,663,404 | B2 | * | 12/2003 | Huscher et al. | 439/164 |
| 6,688,898 | B2 | * | 2/2004 | Nisimoto et al. | 439/164 |
| 7,232,312 | B2 | * | 6/2007 | Wade et al. | 439/4 |
| 7,462,050 | B2 | * | 12/2008 | Yoshimura et al. | 439/164 |

* cited by examiner

*Primary Examiner*—T C Patel
*Assistant Examiner*—Vladimir Imas
(74) *Attorney, Agent, or Firm*—McCarthy Law Group

(57) ABSTRACT

An apparatus and associated method for rotary positioning is provided in an apparatus having an outer housing disposed around an inner housing, wherein at least one of the housings is rotatable with respect to the other housing. The rotary positioner also has a utility circuit having a first flexible circuit connected at one end to the outer housing and connected at an opposing end to the inner housing and forming a loop therebetween having a first u-shaped bend pointing in a first rotational direction in a space between the housings, and having a second flexible circuit connected at one end to the outer housing and connected at an opposing end to the inner housing and forming a loop therebetween having a second u-shaped bend pointing in a second rotational direction opposite to the first rotational direction in the space between the housings.

20 Claims, 5 Drawing Sheets

ROTARY POSITIONING

BACKGROUND

Rotary devices are widely used in the construction of machinery to permit the selective rotation of a workpiece, such as a component or a tool and the like. In automated fabrication and assembly devices, for example, some end effectors are constructed to have an extensible gripping member supported by a rotary positioner so that a gripped workpiece can be rotated in order to place it at different possible rotational orientations.

Generally, such a rotary positioner typically has a fixed structure and a rotating structure. Often times it is necessary to traverse the interface between the fixed and rotating structures with hardware that supplies a utility to the rotating structure, such as in communicating electrical energy or in supplying fluidic energy to the rotating structure.

As for electrical utilities, some previously attempted solutions employ a slip ring to construct a rotating electrical connector. However, a slip ring requires a continuous contacting engagement between circuit terminals and a rotating part, which disadvantageously presents wear and tear issues and particulate contamination issues. Also, slip rings do not provide a hard-wired solution for applications where controlling electrostatic discharge is a requirement.

As for fluidic utilities, some previously attempted solutions employ a rotary union to construct a rotating fluidic connector. However, a rotary union is inherently not well suited for miniaturization; even a rotary union for a small workpiece application is disadvantageously big, bulky, and cumbersome to incorporate into an automated system. Furthermore, the stiction created by the moving seals in a rotary union creates problematic torque and position control issues.

These individual disadvantages associated with using a slip ring or a rotary union are compounded in a system that requires both electrical and fluidic utilities be provided to the rotating structure, meaning that both a slip ring and a rotary union are employed. Improvements are needed in the manner of passing power utilities to the rotating structure of a rotary positioner to resolve these disadvantages associated with the previously attempted solutions. It is to those improvements that the embodiments of the present invention are directed.

SUMMARY OF THE INVENTION

In some embodiments a rotary positioner is provided having an outer housing disposed around an inner housing, wherein at least one of the housings is rotatable with respect to the other housing. The rotary positioner also has a utility circuit having a first flexible circuit connected at one end to the outer housing and connected at an opposing end to the inner housing and forming a loop therebetween having a first u-shaped bend pointing in a first rotational direction in a space between the housings, and having a second flexible circuit connected at one end to the outer housing and connected at an opposing end to the inner housing and forming a loop therebetween having a second u-shaped bend pointing in a second rotational direction opposite to the first rotational direction in the space between the housings.

In some embodiments a rotary positioner is provided that has an outer housing disposed around an inner housing, wherein at least one of the housings is rotatable with respect to the other housing. The rotary positioner also has a utility circuit having first and second flexible circuits, each flexible circuit connected at a proximal end to the outer housing and connected at a distal end to the inner housing and forming a slack loop therebetween in a space between the housings, the slack loops having respective bends pointing in opposite directions so that rotation of the rotatable housing in a first direction unwinds the first flexible circuit from the outer housing and winds the first flexible circuit to the inner housing, and simultaneously unwinds the second flexible circuit from the inner housing and winds the second flexible circuit to the outer housing.

In some embodiments a method is provided including the step of obtaining a rotary positioner having an outer housing disposed around an inner housing, wherein one of the housings is rotatable with respect to the other housing, and having first and second flexible utility circuits, each flexible utility circuit connected at a proximal end to the outer housing and connected at a distal end to the inner housing and forming a loop therebetween in a space between the housings, the loops having respective bends pointing in opposite directions. The method also includes the step of rotating the rotatable housing in a first rotational direction to unwind the first flexible circuit from the outer housing and wind the first flexible circuit to the inner housing, and to simultaneously unwind the second flexible circuit from the inner housing and wind the second flexible circuit to the outer housing.

DETAILED DESCRIPTION

The embodiments of the present invention contemplate an apparatus and an associated method for rotationally positioning a workpiece. A rotary positioner device is disclosed that includes a rotary track that operably communicates utilities across an interface between a rotating portion and a stationary portion of the device. The utilities can be characterized as electrical energy (power or signals) traversing the interface via wiring, or can be characterized as fluid energy (power or signals) traversing the interface via tubing, and the like.

Although the description that follows describes a rotary positioner utilized in an end effector of an automated production machine, the described embodiments are merely illustrative and not limiting of the scope of the invention as claimed. The skilled artisan having read this disclosure readily recognizes equivalent alternative uses of the claimed invention exist, such as but not limited to being employed as a constituent component in a mechanical linkage or transmission and the like.

Figure 1:
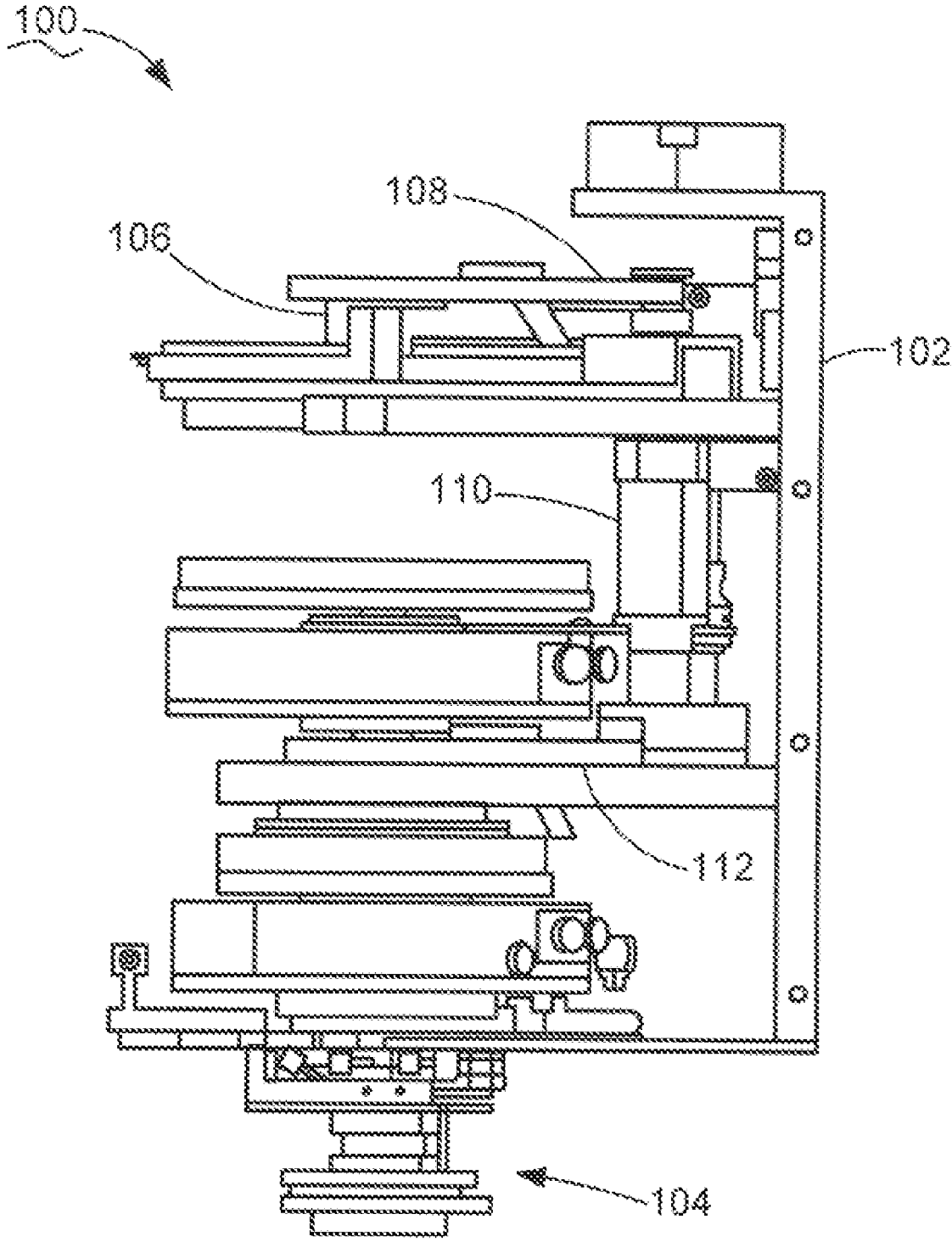
FIG. 1 is an elevational depiction of an end effector that is constructed in accordance with embodiments of the present invention.

Thus, FIG. 1 depicts an elevational view of an end effector 100 that is constructed in accordance with illustrative embodiments of the present invention. The end effector 100 is mounted to a structural framework 102 to position a gripper assembly 104 at a lower end thereof in an appropriate position or sequence of positions to manipulate a workpiece (not shown) as desired.

Figure 2:
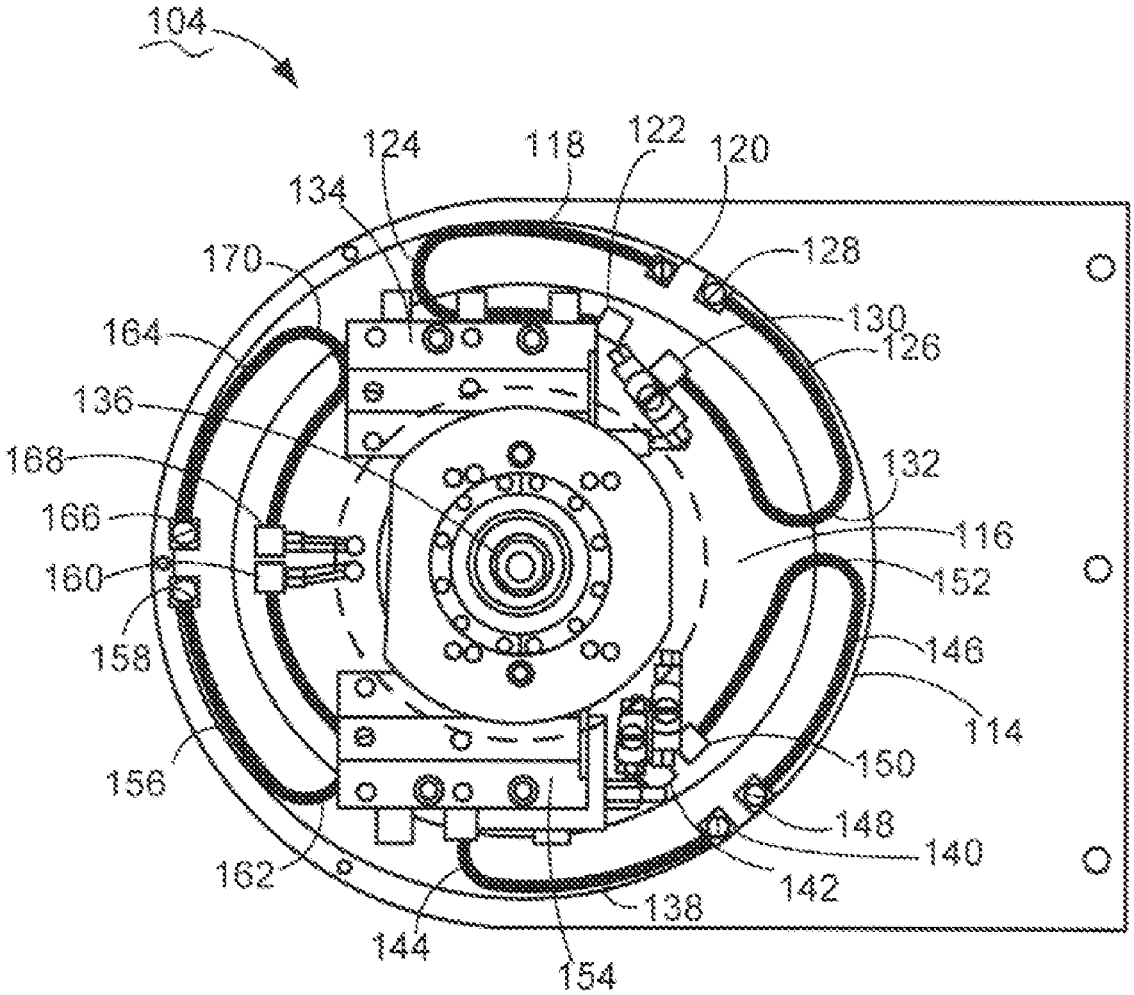
FIG. 2 is a bottom-end view of the end effector of FIG. 1.

The gripper assembly 104 is selectively rotatable by a rotary positioner feature. To that end, a motor 106 transfers rotational motion via belt 112 to rotate an inner housing portion (shown below). FIG. 2 is a bottom-end view of the gripper assembly 104 depicting the stationary outer housing 114 disposed around the rotatable inner housing 116, although the scope of the claimed invention is not limited to these disclosed embodiments. That is, in alternative equivalent embodiments only the outer housing 114 is selectively rotatable and in other alternative embodiments both the outer housing 114 and the inner housing 116 are selectively rotatable. The skilled artisan can readily adapt the disclosed embodiments to those alternative embodiments such that a full enumeration of all possible variations is not necessary for an understanding of the scope of the claimed subject matter.

A utility circuit traverses the interface between the outer housing 114 and the inner housing 116 to provide utilities to the inner housing 116. The utility circuit has a first flexible circuit 118 connected at one end 120 to the outer housing 114 and connected at an opposing end 122 to the inner housing 116, forming a slack loop therebetween having a u-shaped bend 124 pointing in a counter-clockwise rotational direction within a space between the housings 114, 116. The utility circuit further has a second flexible circuit 126 connected at one end 128 to the outer housing 114 and connected at an opposing end 130 to the inner housing 116, forming a slack loop therebetween having a u-shaped bend 132 pointing in a clockwise rotational direction within the space between the housings 114, 116.

Figure 3:
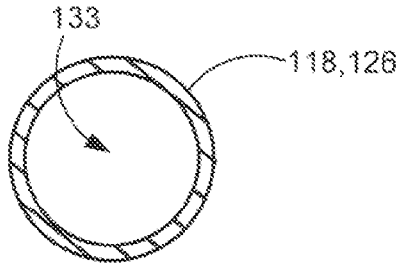
FIG. 3 is a cross-sectional depiction of one of the flexible circuits of the end effector of FIG. 1 used to communicate pressurized fluid.

FIG. 3 is a cross sectional depiction of the first and second flexible circuits 118, 126 showing they are constructed of flexible tubing defining a cavity 133 to communicate fluidic energy, such as pressurized fluid or vacuum, to a gripper cylinder 134 (FIG. 2). The flexible circuits 118, 126 can be isolated with respect to each other to communicate characteristically different utilities. That is, without limitation, pressurizing the flexible circuit 118 while venting the flexible circuit 126 can be designed to extend the gripper cylinder 134 in order to actuate a clamp 136 to a clamped mode. Subsequently venting the flexible circuit 118 and pressurizing the flexible circuit 126 retracts the gripper cylinder 134 to switch the clamp 136 from the clamped mode to an unclamped mode. The clamp 136 is sized with respect to workpieces (not shown) so that the clamp 136 grippingly engages the workpiece in the clamped mode but clearingly disengages the workpiece in the unclamped mode.

Figure 4:
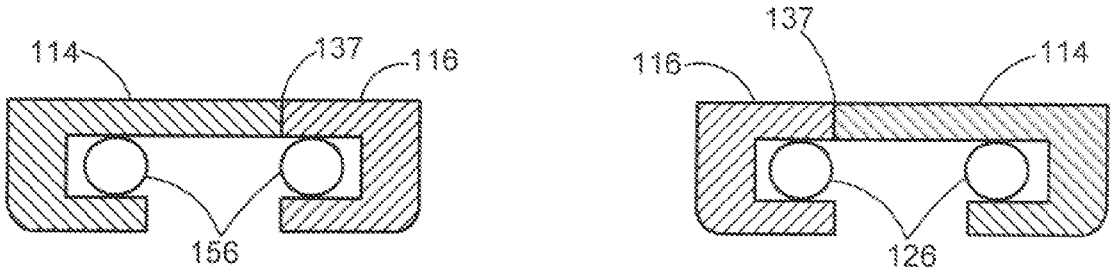
FIG. 4 is a cross-sectional depiction of the rotatable inner housing and the stationary outer housing in the end effector of FIG. 1.

FIG. 4 is a diagrammatic cross sectional view depicting how the inner housing 116 and outer housing 114 have close mating surfaces at the interface 137 therebetween. Both of the housings 114, 116 define cavities that are sized to receivingly engage and support the flexible circuits (such as 126, 156 depicted) while the inner housing 116 rotates. The upper continuous surface and opposing cavities function as a rotary track that guides and supports the slack loops during rotation of the inner housing 116.

The illustrative embodiments depicted by FIG. 2 have three such paired slack loops pointing in opposite directions, although the claimed embodiments are not so limited. In alternative equivalent embodiments there can be one or more such paired slack loops. The lengths of the oppositely paired slack loops cooperatively permit the desired amount of rotation. That is as is better depicted by comparing FIGS. 6 and 7 as discussed below, during rotation one of the slack loops winds off the inner housing 116 to provide clearance for the other slack loop to wind onto the inner housing 116, depending on the direction of rotation. The same is true for the outer housing 114. Thus, the slack loops in embodiments having only one pair can be relatively longer than embodiments with multiple pairs. Testing during reduction to practice of the embodiments of FIG. 2 indicated that more than ninety degrees of rotation is achievable with the three pairs of slack loops.

The embodiments of FIG. 2 discussed below also contemplate two pairs of slack loops being used to communicate fluidic energy and the other pair being used to communicate electrical energy, although the present embodiments are not so limited. For example, in equivalent alternative embodiments all the pairs could be used to communicate the same utility, or one or more pairs could be used to communicate control signals, and the like.

Staying with FIG. 2, similar to the first and second flexible circuits 118, 126, the utility circuit further has a third flexible circuit 138 connected at one end 140 to the outer housing 114 and connected at an opposing end 142 to the inner housing 116, forming a slack loop therebetween having a u-shaped bend 144 pointing in the clockwise rotational direction in the space between the housings 114, 116. A fourth flexible circuit 146 is connected at one end 148 to the outer housing 114 and connected at an opposing end 150 to the inner housing 116, forming a slack loop therebetween having a fourth u-shaped bend 152 pointing in the counter-clockwise rotational direction in the space between the housings 114, 116.

Like the first and second flexible circuits 118, 126, the third and fourth flexible circuits 138, 146 are constructed of flexible tubing to communicate fluidic energy to selectively extend and retract a gripper cylinder 154, respectively, in order to actuate the clamp 136 between the clamped and unclamped modes.

The utility circuit further has a fifth flexible circuit 156 connected at one end 158 to the outer housing 114 and connected at an opposing end 160 to the inner housing 116, forming a slack loop therebetween having a u-shaped bend 162 pointing in the counter clockwise direction in the space between the housings 114, 116. Finally, the utility circuit has a sixth flexible circuit 164 connected at one end 166 to the outer housing 114 and connected at an opposing end 168 to the inner housing 116, forming a slack loop therebetween having a u-shaped bend 170 pointing in the clockwise rotational direction in the space between the housings 114, 116.

Figure 5:
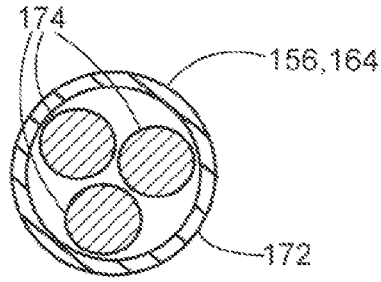
FIG. 5 is a cross-sectional depiction of another one of the flexible circuits of the end effector in FIG. 1 used to communicate electrical energy.

FIG. 5 is a cross sectional depiction of the fifth and sixth flexible circuits 156, 164 showing they are constructed of electrical wiring for communicating electrical energy, which for purposes of this description and meaning of the claims means either electrical power or electrical signals and the like. The depicted flexible circuits 156, 164 consist of an outer protective sheath 172 that encases electrical conductors 174. The conductors 174 can be individually insulated to transmit different things, such as different legs of power or different signals. Traversing the interface between the housings 114, 116 with such an electrical communication permits providing power or control signals to the workpiece being handled by the gripper assembly 104.

Figure 7:
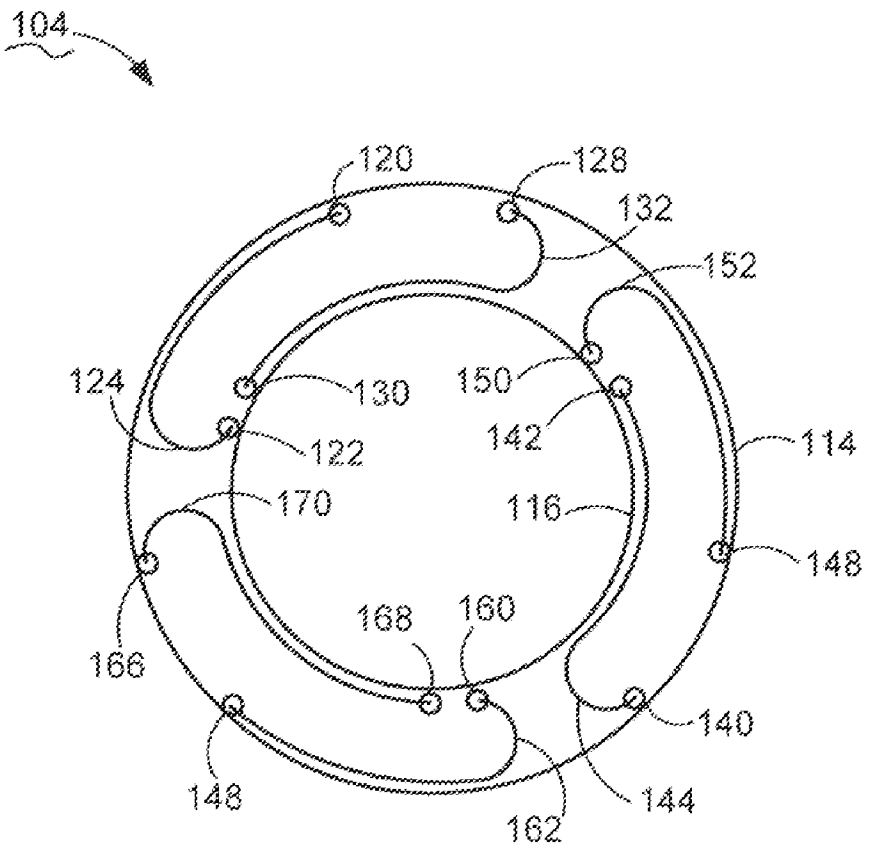
FIG. 7 diagrammatically depicts the rotary track portion of the bottom-end view of FIG. 2 at the extent of counter-clockwise rotation of the inner housing.
Figure 6:
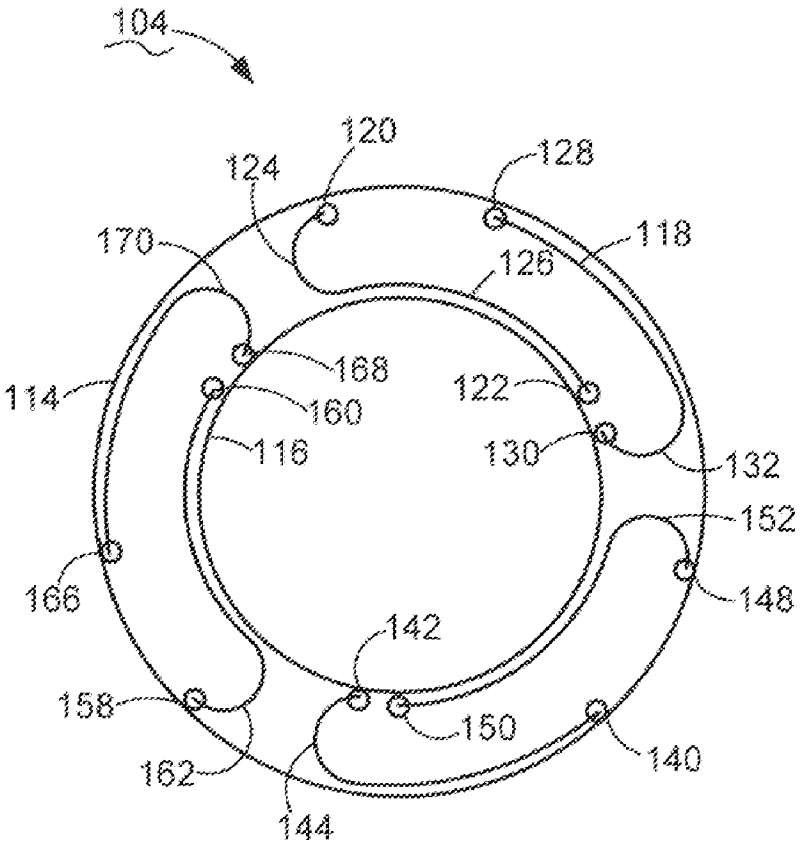
FIG. 6 diagrammatically depicts the rotary track portion of the bottom-end view of FIG. 2 at the extent of clockwise rotation of the inner housing.

FIGS. 6 and 7 are diagrammatic functional depictions of the rotary track depicted in the bottom-end view of the gripper assembly 104 in FIG. 2. The slack loops are all diagrammatically depicted by a single centerline for clarity sake. FIG. 6 depicts the inner housing 116 having been rotated to the extent of rotational movement in the clockwise direction, and FIG. 7 conversely depicts the inner housing 116 having been rotated to the extent of rotational movement in the counter-clockwise direction.

The three paired slack loops are individually long enough to permit the inner housing 116 to rotate up to about 95 degrees between the opposing extents of rotation. That amount of rotational movement is made possible by the pairing up of oppositely pointing slack loops. That is, at the clockwise extent of rotational movement depicted in FIG. 6 both ends 122, 130 of the first and second flexible circuits 118, 126 connected to the inner housing 116 are angularly disposed on one side of the other ends 120, 128 of the first and second flexible circuits 118, 126 connected to the outer housing 114. However, FIG. 7 shows that when the inner housing 116 is rotated to the counter-clockwise extent of rotational movement, the ends 122, 130 of the first and second flexible circuits 118, 126 connected to the inner housing 116 are angularly disposed on the other side of the opposing ends 120, 128 of the first and second flexible circuits 118, 126 connected to the outer housing 114.

As described, the paired up slack loops form oppositely pointing bends (such as 124, 132). Thus, the result of rotation of the housing 116 in the clockwise direction is that the first flexible circuit 118 unwinds from the inner housing 116 and winds to the outer housing 114. Simultaneously, the second flexible circuit 126 unwinds from the outer housing 114 and winds to inner housing 116.

Figure 9:
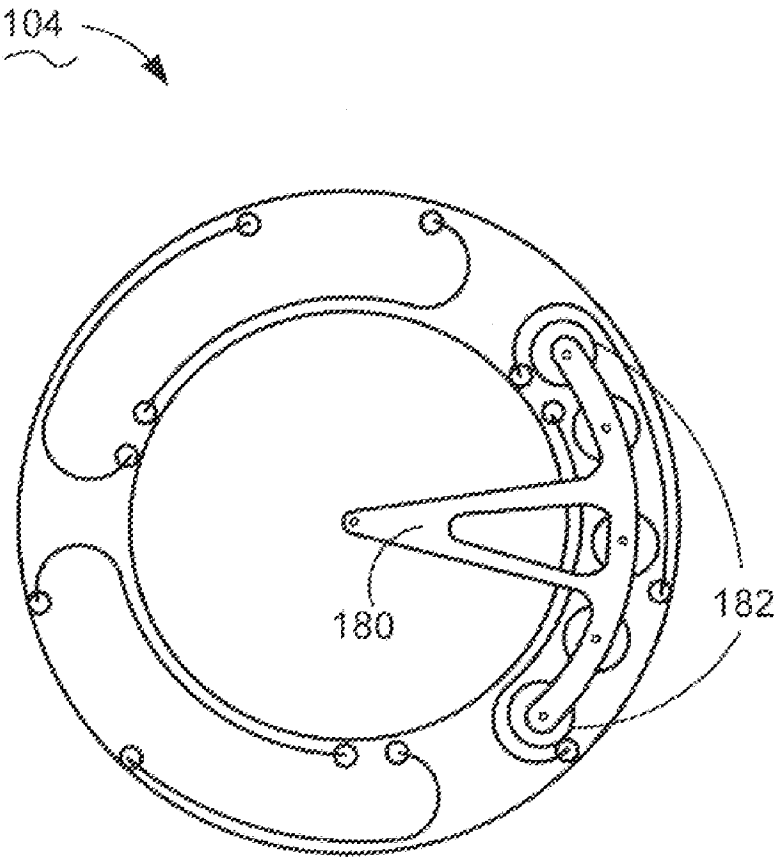
FIG. 9 is a view similar to FIG. 7 but with the addition of a yoke in the space between the inner and outer housings.
Figure 8:
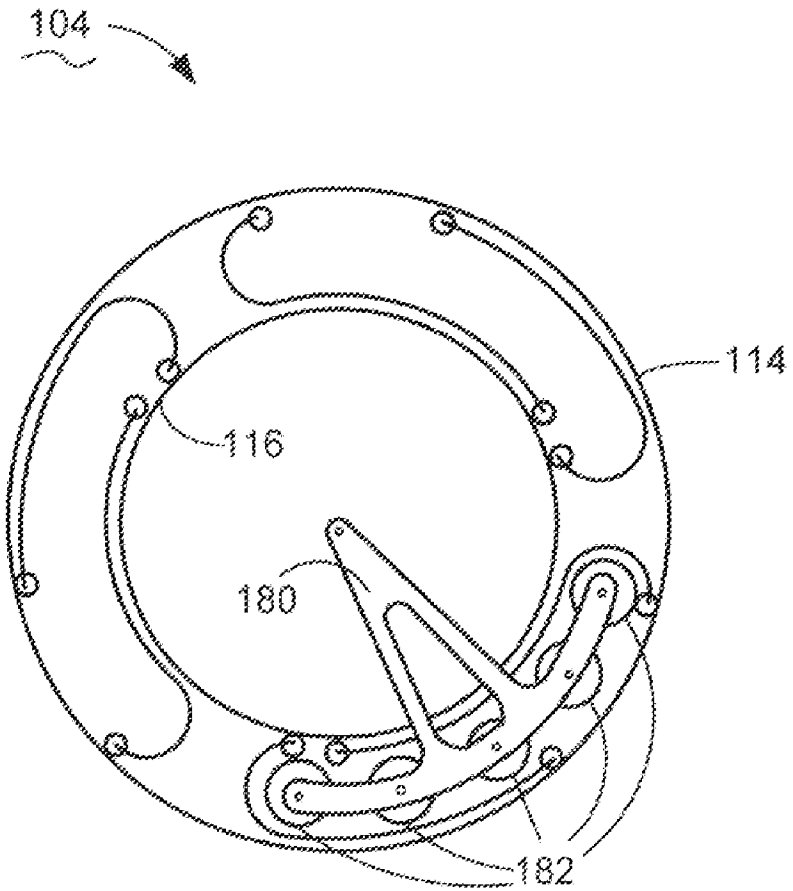
FIG. 8 is a view similar to FIG. 6 but with the addition of a yoke in the space between the inner and outer housings.

FIGS. 8 and 9 are the similar to FIGS. 6 and 7 but with the addition of a yoke 180 that is pinned at a proximal end at the axis of rotation of the inner housing 116, although the claimed embodiments are not so limited. That is, it will be understood that the purpose for pinning the yoke 180 is generally to guide it within the space between the housings 114, 116 during rotation. In equivalent alternative embodiments the yoke 180 can be guided without pinning it, such as but not limited to providing it with a bearing surface that contactingly engages one or both of the housings 114, 116 or the slack loops or both during rotation.

The illustrative yoke 180 generally includes a framework for supporting a plurality of rollers 182 in the space between the housings 114, 116, although the present embodiments are not so limited. That is, in equivalent alternative embodiments other engagement members such as but not limited to slider surfaces can be used. The span between the outermost rollers 182 defines the arc length of the slack loop, in that they define arcuate surfaces around which the flexible circuits are trained while winding from or winding to the housings 114, 116 during rotation of the inner housing 116. The outermost rollers 182 thereby supportingly engage the u-shaped bends to prevent kinking.

The present embodiments further contemplate a method including the step of obtaining the rotary positioner described above having the outer housing 114 disposed around the inner housing 116, wherein one of the housings is rotatable with respect to the other housing, and having the first and second flexible utility circuits, each flexible utility circuit connected at a proximal end to the outer housing 114 and connected at a distal end to the inner housing 116 and forming a slack loop with oppositely pointing bends in the space between the housings 114, 116. The method further includes the step of rotating the rotatable housing to unwind the first flexible circuit from the outer housing to the inner housing, and to simultaneously unwind the second flexible circuit from the inner housing to the outer housing.

The foregoing discussion has been presented for purposes of illustration and description. The foregoing is not intended to limit the embodiments to the form or forms disclosed herein. In the foregoing for example, various features of the claimed invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of any of the disclosed embodiments. Thus, the following claims are hereby incorporated into this description, with each claim standing on its own as separate embodiments of the invention.

Moreover, though the description of the claimed invention has included description of one or more embodiments and certain variations and modifications, other variations and modifications are within the scope of the claimed invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed:

1. A rotary positioner comprising:

an outer housing disposed around an inner housing, wherein at least one of the housings is rotatable with respect to the other housing; and a utility circuit having a first flexible circuit connected at one end to the outer housing and connected at an opposing end to the inner housing and forming a loop therebetween having a first u-shaped bend pointing in a first rotational direction in a space between the housings, and having a second flexible circuit connected at one end to the outer housing and connected at an opposing end to the inner housing and forming a loop therebetween having a second u-shaped bend pointing in a second rotational direction opposite to the first rotational direction in the space between the housings.

2. The rotary positioner of claim 1 wherein the utility circuit further comprises a third flexible circuit connected at one end to the outer housing and connected at an opposing end to the inner housing and forming a loop therebetween having a third u-shaped bend pointing in the first rotational direction in the space between the housings.

3. The rotary positioner of claim 2 wherein the utility circuit further comprises a fourth flexible circuit connected at one end to the outer housing and connected at an opposing end to the inner housing and forming a loop therebetween having a fourth u-shaped bend pointing in the second rotational direction in the space between the housings.

4. The rotary positioner of claim 3 wherein the utility circuit further comprises a fifth flexible circuit connected at one end to the outer housing and connected at an opposing end to the inner housing and forming a loop therebetween having a fifth u-shaped bend pointing in the first rotational direction in the space between the housings.

5. The rotary positioner of claim 4 wherein the utility circuit further comprises a sixth flexible circuit connected at one end to the outer housing and connected at an opposing end to the inner housing and forming a loop therebetween having a sixth u-shaped bend pointing in the second rotational direction in the space between the housings.

6. The rotary positioner of claim 1 wherein the first flexible circuit and second flexible circuit are isolated with respect to each other and communicate different utilities between the outer and inner housings.

7. The rotary positioner of claim 6 wherein at least one of the first and second flexible circuits comprises an annular tube configured for communicating fluidic energy between the outer and inner housings.

8. The rotary positioner of claim 6 wherein at least one of the first and second flexible circuits comprises a conductor configured for communicating electrical energy between the outer and inner housings.

9. The rotary positioner of claim 1 further comprising a yoke rotated by the rotatable housing and defining an arcuate surface in the space between the housings that is sized to supportingly engage one of the u-shaped bends.

10. The rotary positioner of claim 9 wherein the yoke defines two arcuate surfaces in the space between the housings that are sized to simultaneously supportingly engage two different u-shaped bends.

11. The rotary positioner of claim 1 wherein both ends of the first and second flexible circuits connected to the inner housing are angularly disposed on one side of the opposing ends of the first and second flexible circuits connected to the outer housing at an extent of rotational movement in the first rotational direction, and wherein both ends of the first and second flexible circuits connected to the inner housing are angularly disposed on the other side of the opposing ends of the first and second flexible circuits connected to the outer housing at an extent of rotational movement in the second rotational direction.

12. The rotary positioner of claim 1 wherein the first and second flexible circuits are long enough to operably permit at least ninety degrees of rotation between the housings.

13. A rotary positioner comprising:

an outer housing disposed around an inner housing, wherein at least one of the housings is rotatable with respect to the other housing; and a utility circuit having first and second flexible circuits, each flexible circuit connected at a proximal end to the outer housing and connected at a distal end to the inner housing and forming a slack loop therebetween in a space between the housings, the slack loops having respective bends pointing in opposite directions so that rotation of the rotatable housing in a first direction unwinds the first flexible circuit from the outer housing and winds the first flexible circuit to the inner housing, and simultaneously unwinds the second flexible circuit from the inner housing and winds the second flexible circuit to the outer housing.

14. The rotary positioner of claim 13 wherein the first flexible circuit and second flexible circuit are isolated with respect to each other and operably communicate different utilities between the outer and inner housings.

15. The rotary positioner of claim 14 wherein at least one of the first and second flexible circuits comprises an annular tube configured for operably communicating fluidic energy.

16. The rotary positioner of claim 14 wherein at least one of the first and second flexible circuits comprises a conductor configured for operably communicating electrical energy.

17. The rotary positioner of claim 13 further comprising a yoke rotated by the rotatable housing and defining arcuate surfaces in the space between the housings that are sized to operably supportingly engage the flexible circuit at the respective bends.

18. The rotary positioner of claim 13 wherein both ends of the first and second flexible circuits connected to the inner housing are angularly disposed on one side of both ends of the first and second flexible circuits connected to the outer housing at an extent of rotational movement in the first rotational direction, and wherein both ends of the first and second flexible circuits connected to the inner housing are angularly disposed on the other side of both ends of the first and second flexible circuits connected to the outer housing at an extent of rotational movement in the second rotational direction.

19. The rotary positioner of claim 13 wherein the first and second flexible circuits are long enough to operably permit at least ninety degrees of rotation between the housings from the extent of rotation in the first rotational direction to the extent of rotation in the second rotational direction.

20. A method comprising:

obtaining a rotary positioner having an outer housing disposed around an inner housing, wherein one of the housings is rotatable with respect to the other housing, and having first and second flexible utility circuits, each flexible utility circuit connected at a proximal end to the outer housing and connected at a distal end to the inner housing and forming a loop therebetween in a space between the housings, the loops having respective bends pointing in opposite directions; and rotating the rotatable housing in a first rotational direction to unwind the first flexible circuit from the outer housing and wind the first flexible circuit to the inner housing, and to simultaneously unwind the second flexible circuit from the inner housing and wind the second flexible circuit to the outer housing.

* * * * *